United States Patent [19]

Hultgren

[11] 4,354,447

[45] Oct. 19, 1982

[54] EXTENDABLE BOWSPRIT PULPIT FOR A FISHING BOAT

[76] Inventor: Lennart C. Hultgren, 40 Ryder St., Buzzard's Bay, Mass. 02532

[21] Appl. No.: 181,717

[22] Filed: Aug. 27, 1980

[51] Int. Cl.[3] ..... B63B 35/14

[52] U.S. Cl. ..... 114/255; 14/71.1; 114/343

[58] Field of Search ..... 114/255, 56, 221 R, 114/343, 362, 364; 14/71.1, 69.5, 71.3; 440/105; 405/218

[56] References Cited

U.S. PATENT DOCUMENTS 926,847 7/1909 Carey, Jr. ..... 440/105

4,106,150 8/1978 Irwin ..... 405/218 X

FOREIGN PATENT DOCUMENTS 2545708 4/1977 Fed. Rep. of Germany ..... 14/71.3

OTHER PUBLICATIONS

"Boating," Aug. 1978, vol. 44, No. 2, p. 88.

*Primary Examiner*—Sherman D. Basinger

*Attorney, Agent, or Firm*—Merrill N. Johnson

[57] ABSTRACT

An extendable bowsprit pulpit for a fishing boat, comprising an elongated pulpit affixed to the bow of the boat, a slidable pulpit extension which fits into the elongated pulpit and is capable of being retracted to lie mainly within said elongated pulpit and of being slidably extended so that the major portion of said pulpit extension lies forwardly of the elongated pulpit as an extension thereof, a pair of bow supports each having one end attached to the forward portion of the elongated pulpit and its other end connected to a bracket mounted on the boat's bow beneath the elongated pulpit, a slidably extendable railing surrounding the bowsprit pulpit in both its retracted and extended positions, and power operated means connected to said slidable pulpit extension for extending and retracting said pulpit extension.

5 Claims, 4 Drawing Figures

EXTENDABLE BOWSPRIT PULPIT FOR A FISHING BOAT

BRIEF SUMMARY OF THE INVENTION

In various fishing operations both of a commercial and a sporting nature it is often desirable to position a man forward of the bow of the boat, so that the man might more conveniently engage in such activities as harpooning or netting fish in the water forward of the bow of the fishing boat.

To accommodate such a man, some fishing boats have been equipped with a pulpit which extends out over the bow to provide a platform three or four feet forward of the actual bow of the boat. Cusomarily this pulpit includes a waist-high railing, and in some cases the deck of the pulpit contains a pulley and a slot for raising and storing the boat's anchor. These latter pulpits are commonly known as anchor pulpits.

However, in many fishing operations such fixed pulpits do not permit the fisherman to position himself sufficiently forward of the boat's bow to most advantageously locate himself for harpooning, netting or other operation.

Accordingly, it is the purpose of my invention to provide a safe, simple and economically constructed bowsprit pulpit which permits ideal location of a fisherman forward of the bow of a fishing boat and which can be extended or retracted as desired by the boat's captain.

Briefly stated, my invention is an extendable bowsprit pulpit for a fishing boat which comprises an elongated pulpit affixed to the bow of a boat by suitable means, a slidable pulpit extension which fits into the elongated pulpit and is capable of being retracted so as to lie mainly within the elongated pulpit and of being extended so that the major portion of said pulpit extension lies forwardly of the elongated pulpit as an extension thereof, and a pair of bow supports each having one end attached to the forward portion of the elongated pulpit and its other end connected to a bracket mounted somewhat above the waterline on the boat's bow beneath the elongated pulpit. Power actuated means, such as a power driven screw or a hydraulic cylinder assembly, may be attached to the slidable pulpit extension for easily extending and retracting the pulpit extension.

Preferably the deck of both the elongated pulpit and the pulpit extension is made of expanded anodized aluminum matting welded to the top side of two parallel and identical "C" shaped channels or members also of anodized aluminum or other salt-resistant metal, which form the main supporting members of the bowsprit pulpit. The two channels of the pulpit extension are preferably selected to fit within the two channels of the fixed elongated pulpit, so that the pulpit extension can be slid back and forth in relation to the fixed pulpit.

The pulpit extension includes a nose portion which in both the extended and retracted positions of the pulpit extension forms the bowsprit pulpit's forwardmost portion. Both the elongated pulpit and the pulpit extension include a waist-high railing of stainless metal encircling the deck of the entire bowsprit pulpit in both its retracted and extended positions.

My extendable bowsprit pulpit has the advantage of putting the harpoonist or netter well out in front of the bow of the boat, say twenty feet or more, to most efficiently perform his tasks, while also permitting the boat's captain to retract the pulpit to a more convenient position as in foul weather to prevent damage to the pulpit. Also, with the bowsprit pulpit in its retracted position, the boat can be more easily maneuvered and docked in less space, thus saving docking expense.

DETAILED DESCRIPTION

Figure 1:
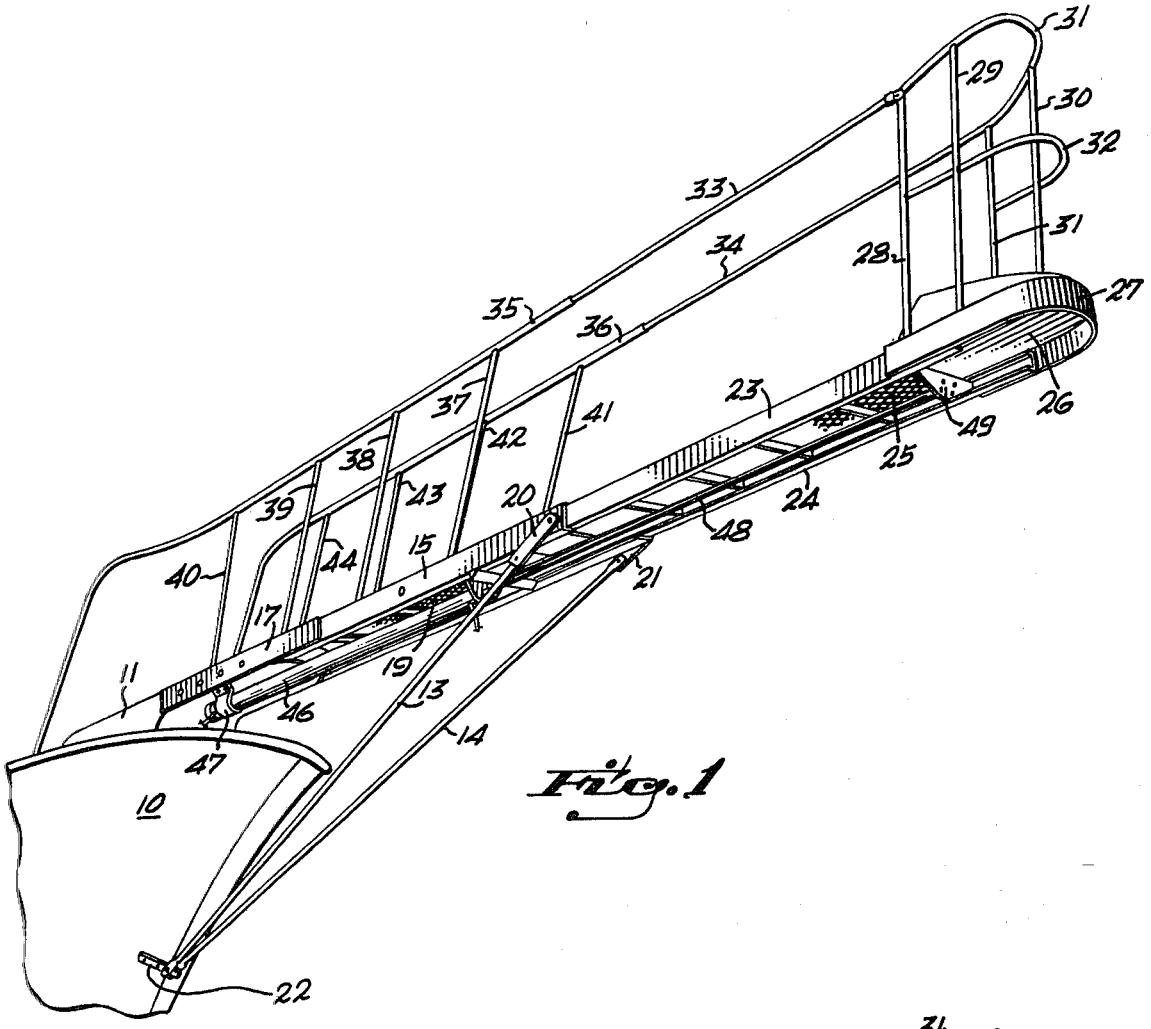
FIG. 1 is a view in perspective showing a preferred form of the bowsprit pulpit in its extended position and mounted on a fishing boat.

FIG. 1 of the accompanying drawings shows a preferred form of the extendable bowsprit pulpit mounted on the bow 10 of a typical fishing boat. The fishing boat has on its deck and extending forward of its bow an anodized aluminum pulpit 11 of a type known in the art and shown in FIGS. 1, 2 and 3.

Figure 4:
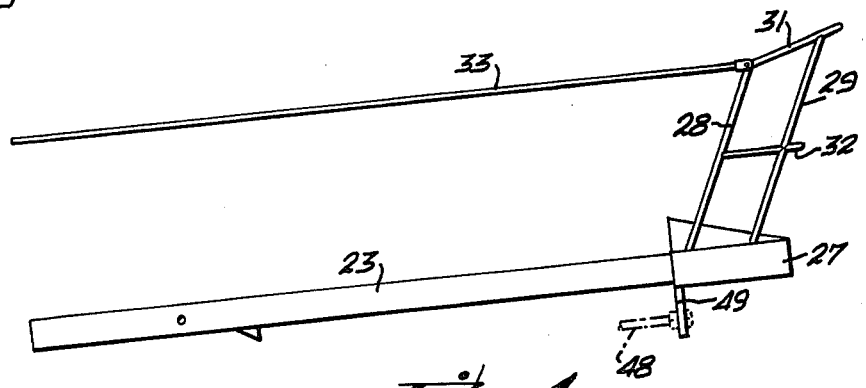
FIG. 4 is a side view of the pulpit extension by itself showing in dotted lines the connection of the hydraulic piston rod to the pulpit extension.
Figure 2:
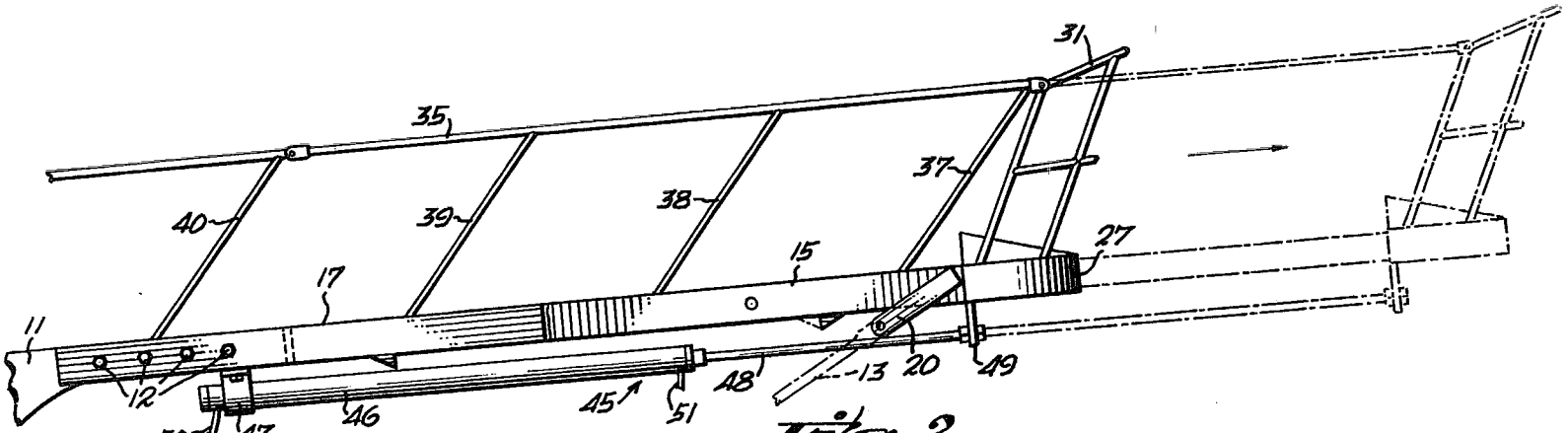
FIG. 2 is a side view of the bowsprit pulpit in its retracted position and showing in dotted lines the pulpit extension in its extended position.
Figure 3:
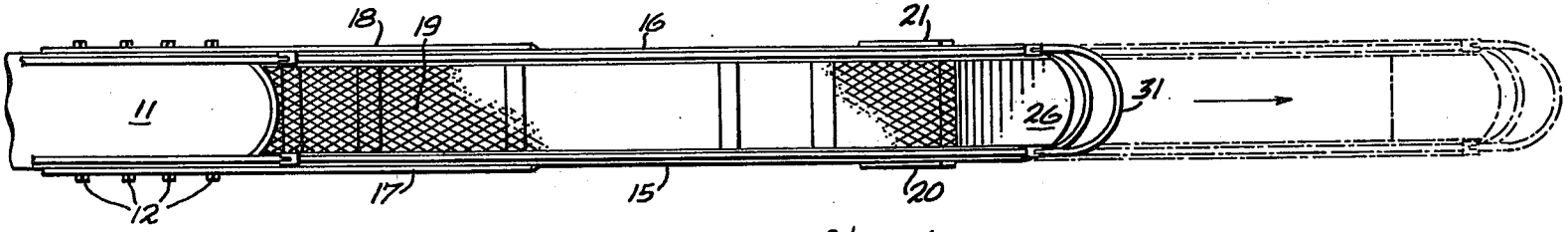
FIG. 3 is a plan view of the bowsprit pulpit in its retracted position and showing in dotted lines the pulpit extension in its extended position.

The extendable bowsprit pulpit is attached to this known pulpit 11 by two series of bolts 12 best shown in FIGS. 2 and 3. The extendable bowsprit pulpit includes two sub-assemblies, namely, an elongated pulpit firmly affixed to the pulpit 11 and also supported by a pair of bow supports 13 and 14 best shown in FIG. 1, and a slidable pulpit extension best shown in FIG. 4.

The elongated pulpit sub-assembly includes two U or C-shaped channels 15 and 16 preferably of anodized aluminum onto which are welded stainless plates 17 and 18. Plates 17 and 18 are drilled to receive bolts 12 which affix the extended bowsprit pulpit to the boat's pulpit 11.

The deck 19 of the elongated pulpit sub-assembly is made of expanded or preforated aluminum or stainless steel welded to the upper face of channels 15 and 16. Near the forward end of each channel two similar plates 20 and 21 are welded to the channels and drilled for connection to the pair of bow supports 13 and 14 preferably constructed of tubular stainless steel. The opposite ends of supports 13 and 14 are affixed to a supporting bracket 22 securely mounted on the bow of the fishing boat beneath the boat's deck and normally above the water line.

The slidable pulpit extension sub-assembly also includes two similar and parallel U or C-shaped channels 23 and 24 which are sized to fit within the channels 15 and 16 respectively of the elongated pulpit sub-assembly. The deck 25 of the pulpit extension is made of stainless expanded metal welded to the upper surfaces of channels 23 and 24. The front end of the pulpit extension includes a nose portion having a flat semi-circular nose 27 made of bar stock and welded to channels 23 and 24. Deck 26 and nose 27 in both the retracted and the extended position serves as the front end of the bowsprit pulpit.

A series of tubular posts 28, 29, 30 and 31 whose lower ends are welded to nose 27 support two semi-circular railings 31 and 32, located waist-high and knee high respectively in relation to deck 26. Two tubular rails 33 and 34 each welded to one end of railing 31 have opposite ends which slide into two parallel side railings 35 and 36 respectively. Side railings 35 and 36 are mounted on a series of tubular posts 37, 38, 39, 40, 41, 42, 43 and 44 whose lower ends are welded to the elongated pulpit or fixed pulpit 11 as best shown in FIG. 1.

The combination of semi-circular railings 31 and 32, rails 33 and 34 and side railings 35 and 36 provide a continuous safety railing encircling the bowsprit pulpit in both its retracted and extended positions.

Power operated means is provided to authomatically extend or retract the sliding pulpit extension sub-assembly, which may include one or more electrically driven screws or hydraulic cylinders. In the preferred embodiment as shown, power is supplied by a hydraulic piston and cylinder assembly shown generally as 45 mounted beneath the elongated pulpit sub-assembly and best shown in FIG. 2.

Assembly 45 includes a cylinder 46 suspended from channels 15 and 16 by bracket 47 and a piston rod 48 whose front end is connected to flange 49 which is welded to channels 23 and 24. Cylinder 46 is connected to a known type of fluid delivery system not shown by lines 50 and 51 shown in broken-away form in FIG. 2.

I claim:

1. A slidably extendable bowsprit pulpit for mounting on the bow of a fishing boat comprising:

an elongated pulpit having a horizontal deck extending forwardly of the boat's bow deck and two parallel deck-supporting members each having one end affixed to the boat's bow and extending forwardly beneath said horizontal deck, a slidable pulpit extension having a horizontal deck and two parallel deck-supporting members, each member being slidably mounted on one of the two deck-supporting members of the elongated pulpit, and a rigid support member having one end affixed to the forward end of said elongated pulpit and its other end affixed to a bracket mounted on the boat's bow beneath the bow deck, said slidable pulpit extension capable of being retracted to lie mainly within said elongated pulpit and of being slidably extended so that the major portion thereof lies forwardly of the elongated pulpit.

2. A bowsprit pulpit according to claim 1, in which the forward end of the elongated pulpit is supported by two rigid support members, each having one end affixed to the forward end of one of the deck-supporting members of the elongated pulpit and its other end affixed to a bracket mounted on the boat's bow beneath the bow deck.

3. A bowsprit pulpit according to claim 1 or 2, in which the pulpit extension includes a nose portion which in both the pulpit extension's retracted and extended position forms the bowsprit pulpit's forwardmost extension.

4. A slidably extendable bowsprit pulpit for mounting on the bow of a fishing boat comprising:

an elongated pulpit having a horizontal deck extending forwardly of the boat's bow deck and two parallel deck-supporting members each having one end affixed to the boat's bow and extending forwardly beneath said horizontal deck, a slidable pulpit extension having a horizontal deck and two parallel deck-supporting members, each of said members being slidably mounted on one of the two deck-supporting members of the elongated pulpit, said pulpit extension including a nose portion which in both the pulpit extension's retracted and extended positions forms the bowsprit pulpit's forwardmost extension, two rigid support members, each having one end affixed to the forward end of one of the deck-supporting members of the elongated pulpit and its other end affixed to a bracket mounted on the boat's bow beneath the bow deck, and a slidably extendable railing above and surrounding the bowsprit pulpit's horizontal deck and nose portion in both its retracted and extended positions.

5. A bowsprit pulpit according to claim 4, in which power actuated means attached to the pulpit extension permits extension or retraction of the slidable pulpit extension.

* * * * *